US007171143B2

(12) United States Patent
Yamasaku

(10) Patent No.: US 7,171,143 B2
(45) Date of Patent: Jan. 30, 2007

(54) TONER CONCENTRATION ADJUSTMENT METHOD AND APPARATUS FOR LIQUID-DEVELOPMENT ELECTROPHOTOGRAPHIC APPARATUS

(75) Inventor: Norihiro Yamasaku, Oyabe (JP)

(73) Assignee: PFU Limited, Kahoku (JP)

( * ) Notice: Subject to any disclaimer, the term of this patent is extended or adjusted under 35 U.S.C. 154(b) by 142 days.

(21) Appl. No.: 10/527,983

(22) PCT Filed: Mar. 9, 2004

(86) PCT No.: PCT/JP2004/003036

§ 371 (c)(1),
(2), (4) Date: Mar. 21, 2005

(87) PCT Pub. No.: WO2004/081674

PCT Pub. Date: Sep. 23, 2004

(65) Prior Publication Data

US 2006/0045552 A1 Mar. 2, 2006

(30) Foreign Application Priority Data

Mar. 13, 2003 (JP) ..... 2003-067520

(51) Int. Cl.
*G03G 15/10* (2006.01)
*G03G 21/10* (2006.01)

(52) U.S. Cl. ..... 399/237; 399/359

(58) Field of Classification Search ..... 399/57, 399/359, 237, 250

See application file for complete search history.

(56) References Cited

U.S. PATENT DOCUMENTS 4,895,103 A * 1/1990 Day ..... 399/237
6,011,943 A 1/2000 Kim
6,856,778 B2 * 2/2005 Vejtasa et al. ..... 399/237

FOREIGN PATENT DOCUMENTS

| | | |
|---|---|---|
| JP | 61-57841 | 4/1986 |
| JP | 01-097976 | 4/1989 |
| JP | 10-063103 | 3/1998 |
| JP | 10-282796 | 10/1998 |
| JP | 2000-298419 | 10/2000 |
| JP | 2002-006637 | 1/2002 |
| WO | WO 02/093269 A1 | 11/2002 |

OTHER PUBLICATIONS

Supplementary European Search Report, dated Mar. 31, 2006.

* cited by examiner

*Primary Examiner*—Susan Lee

(57) ABSTRACT

Liquid toner which remains on the surface of a photosensitive drum 2 after transfer of a toner image to an intermediate transfer member 1 is collected in a collection pot 6*a*. The collected liquid toner is led to a carrier pot 20, and is stored there. In response to an instruction, the stored liquid toner is fed to a toner concentration adjustment apparatus 10. Liquid toner which remains on the surface of a development roller 3 after supply of liquid toner from the development roller 3 to the photosensitive drum 2 is collected in a collection pot 6*b*. The collected liquid toner is fed directly to the toner concentration adjustment apparatus 10. Liquid toner having undergone concentration adjustment in the toner concentration adjustment apparatus 10 is fed to a supply pot 7, from which the liquid toner is supplied to the development roller 3 via a supply roller 4, whereby the liquid toner is used for development of electrostatic latent images. The toner concentration adjustment apparatus 10 includes a carrier extraction mechanism, a toner replenishment mechanism, a toner concentration detection mechanism, etc., which are incorporated in the concentration adjustment pot.

14 Claims, 7 Drawing Sheets

TONER CONCENTRATION ADJUSTMENT APPARATUS 10

CARRIER EXTRACTION MECHANISM 12

TONER CONCENTRATION DETECTION MECHANISM 14

TONER CONCENTRATION ADJUSTMENT METHOD AND APPARATUS FOR LIQUID-DEVELOPMENT ELECTROPHOTOGRAPHIC APPARATUS

This application claims the benefit of PCT International Application Number PCT/JP2004/003036 filed Mar. 9, 2004 and Japanese Application No. 2003-067520, filed Mar. 13, 2003, in Japan, the disclosures of which are incorporated herein by reference.

TECHNICAL FIELD

The present invention relates to a toner concentration adjustment method and apparatus for a liquid-development electrophotographic apparatus that uses liquid toner composed of carrier and toner particles dispersed in the carrier at a predetermined concentration, in which used liquid toner is collected from the liquid-development electrophotographic apparatus and is adjusted to its predetermined original concentration, and the thus-adjusted liquid toner is reused.

BACKGROUND ART

Example systems for adjusting the toner concentration of liquid toner suitable for liquid-development electrophotographic apparatuses include a system in which when the quantity of toner reaches a predetermined level, blank printing is performed so as to accelerate consumption of carrier. (see Patent Document 1); and a system in which residual toner collected from a photosensitive drum is physically separated into high-concentration toner and low-concentration toner (see Patent Document 2).

Patent Document 1: Japanese Patent Application Laid-Open (kokai) No. H10-63103

Patent Document 2: Japanese Patent Application Laid-Open (kokai) No. H10-282796

In a conventional liquid-development electrophotographic apparatus, an electrostatic latent image is formed on a photosensitive drum by means of a well-known image forming process; liquid toner consisting of toner particles of a single color and carrier is supplied to the drum so as to develop the electrostatic latent image, to thereby form a toner image; and the toner image is transferred to an intermediate transfer member. The single-color toner image transferred to the intermediate transfer member mixes with other single-color toner images to thereby form a color image, which is then transferred to a predetermined printing medium.

When image formation is performed in a liquid-development electrophotographic apparatus having the above-described configuration, toner particles contained in liquid toner are consumed at a rate determined by the area of an image portion. In contrast, carrier is generally consumed at a constant rate irrespective of the area of images. Following printing, the residual liquid toner is collected, and is again used for printing. At that time, the concentration of the liquid toner is adjusted to a fixed level by means of a toner concentration adjustment apparatus. Thus, the toner concentration to be adjusted by means of the toner concentration adjustment apparatus always change in accordance with printed images.

A conventional toner concentration adjustment apparatus for such a liquid-development electrophotographic apparatus will be described with reference to FIG. 7. An electrostatic latent image formed on the surface of a photosensitive drum 2 is developed by liquid toner transferred from a development roller 3, so that a toner image is formed. The toner image is transferred to an intermediate transfer member 1. Liquid toner (residual toner) which remains on the surface of the photosensitive drum 2 after transfer of the toner image to the intermediate transfer member 1 is scraped off by means of a collection blade 5*a*, and is collected in a collection pot 6*a*. Since the greater portion of toner particles forming the image is transferred to the surface of the intermediate transfer member 1, the liquid toner collected in the collection pot 6*a* is mainly composed of carrier. Moreover, liquid toner which remains on the surface of the development roller 3 after transfer of the liquid toner to the photosensitive drum 2 is scraped off by means of a collection blade 5*b*, and is collected in a collection pot 6*b*.

The liquid toner collected in the collection pot 6*a* and the liquid toner collected in the collection pot 6*b* are both fed to a toner concentration adjustment apparatus 50. In the toner concentration adjustment apparatus 50, the liquid toner is mixed with high-concentration toner (liquid toner which contains toner particles at a greater proportion than does the liquid toner used for printing) within a concentration adjustment pot 51 under monitoring by a toner concentration detection mechanism 54. The high-concentration toner is supplied from a high-concentration toner replenishment mechanism 53. In this manner, toner particles lost in a printing process are replenished so as to increase toner concentration; and liquid toner having a predetermined toner concentration is transferred, as regenerated toner, to a supply pot 7, and is then used again.

The high-concentration toner to be mixed with the liquid toner in the concentration adjustment pot must have properties of liquid toner. Thus, the concentration of the high-concentration toner cannot be increased to a level at which the proportion of toner particles contained in the high-concentration toner exceeds about 30%. Therefore, when the high-concentration toner is supplied for concentration adjustment, not only the necessary toner particles, but also carrier is supplied, so that the quantity of regenerated liquid toner increases on the whole.

Moreover, in the case where toner particles are consumed at a large rate in a printing process because of, for example, a large designated printing area, the quantity of toner particles to be replenished becomes large as compared with the residual quantity of carrier, whereby a larger quantity of the high-concentration toner is needed for concentration adjustment.

As a result, in the toner concentration adjustment apparatus 50, which produces regenerated liquid toner, the quantity of the regenerated liquid toner increases, with the possible result that the liquid toner spills over from the concentration adjustment pot 51.

DISCLOSURE OF THE INVENTION

As described above, the conventional technique has a problem in that since liquid toner collected from the surface of a photosensitive drum contains a large quantity of carrier, and high-concentration toner used for adjustment of toner concentration also contains carrier, regenerated toner is produced excessively, with the possible result that the liquid toner spills over from a concentration adjustment pot.

The present invention was accomplished to solve the above-mentioned problem, and an object of the present invention is to reduce the quantity of high-concentration toner required for adjustment of toner concentration during toner regeneration, and thus reduce the quantity of regenerated toner, to thereby prevent a level increase of liquid toner and thus prevent spillover of liquid toner from a pot.

The present invention provides a toner concentration adjustment method for a liquid-development electrophotographic apparatus which uses liquid toner composed of carrier and toner particles dispersed in the carrier at a predetermined concentration. In the method, used liquid toner is collected from the liquid-development electrophotographic apparatus and is adjusted to its predetermined original concentration, and the thus-adjusted liquid toner is recycled. The collected liquid toner is introduced into a concentration adjustment pot, which is replenished with carrier and high-concentration toner which contains toner particles at a greater proportion than does the liquid toner used in the liquid-development electrophotographic apparatus. The carrier is separated and extracted from the liquid toner stored in the concentration adjustment pot so as to adjust the liquid toner concentration to a predetermined concentration. The liquid toner having been adjusted to the predetermined concentration is reused in the liquid-development electrophotographic apparatus.

The present invention provides a toner concentration adjustment apparatus for a liquid-development electrophotographic apparatus, which comprises a concentration adjustment pot into which collected liquid toner is introduced; supply mechanisms for replenishing carrier and high-concentration toner, respectively, the high-concentration toner containing toner particles at a greater proportion than does the liquid toner used in the liquid-development electrophotographic apparatus; and a carrier extraction mechanism for separating and extracting the carrier from the liquid toner stored in the concentration adjustment pot. The liquid toner having been adjusted to the predetermined concentration in the concentration adjustment pot is reused in the liquid-development electrophotographic apparatus.

The carrier extraction mechanism includes a first roller immersed in the liquid toner stored in the concentration adjustment pot and driven to rotate; a second roller rotated on the first roller and receiving liquid toner from the first roller; a third roller for receiving a layer of the liquid toner from the second roller; and a bias voltage source for applying a bias voltage between the second and third rollers. By means of the applied bias voltage, toner particles contained in the liquid toner are caused to remain on the second roller, and the carrier is caused to move to the third roller. The carrier having moved to the third roller is collected.

The toner concentration adjustment apparatus further comprises a mechanism for detecting the concentration of the liquid toner stored in the concentration adjustment pot. This mechanism includes a supply roller immersed in liquid toner stored in the concentration adjustment pot, and rotated at a predetermined speed; a reflection roller which rotates on the supply roller and receives liquid toner therefrom; and an optical sensor provided at a position facing the reflection roller.

BEST MODE FOR CARRYING OUT THE INVENTION

Figure 1:
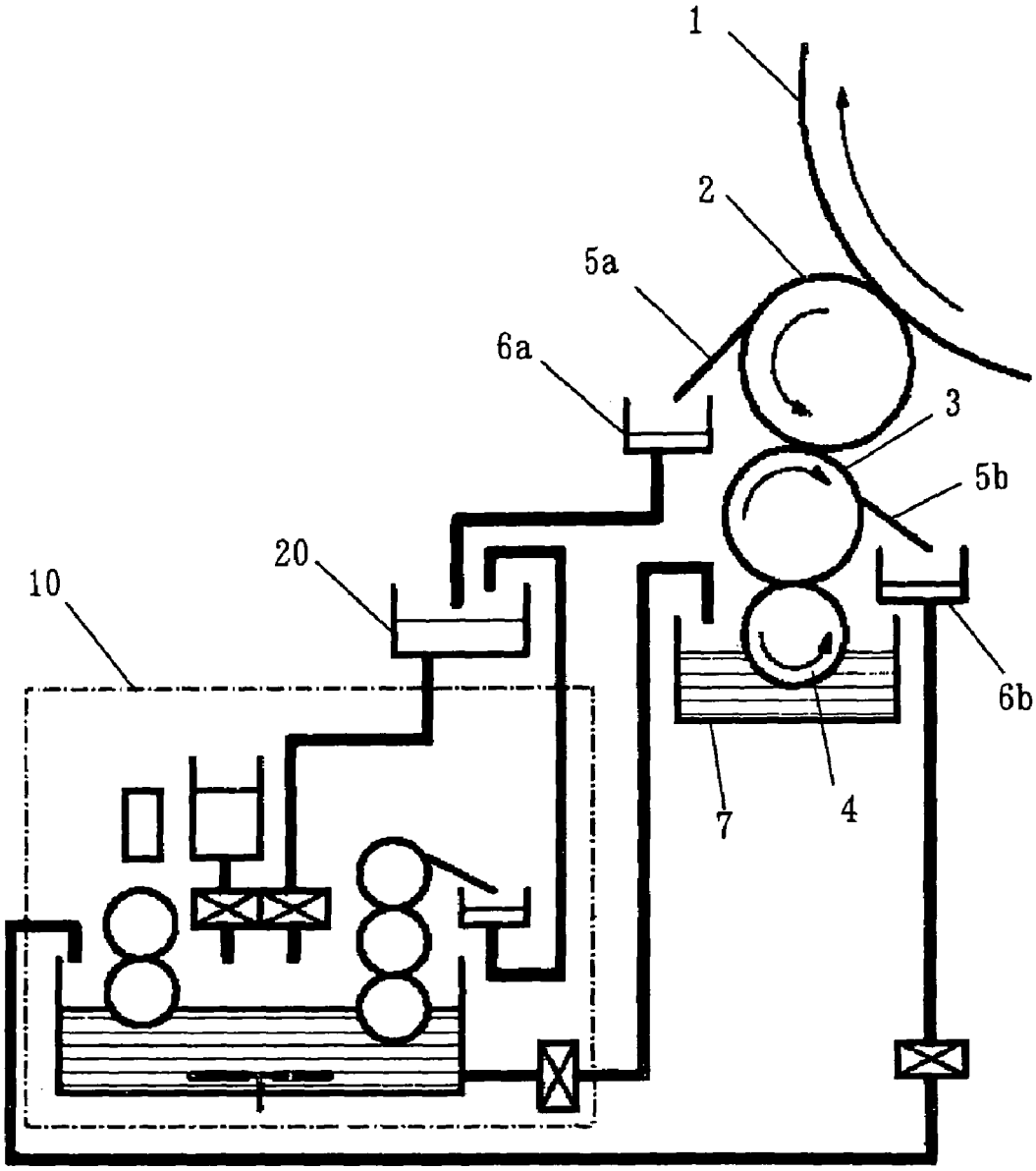
FIG. 1 is a view showing a toner concentration adjustment apparatus provided in a liquid-development electrophotographic apparatus.

The present invention will next be described, by way of example. FIG. 1 is a view showing a toner concentration adjustment apparatus provided in a liquid-development electrophotographic apparatus. Under the present invention, after liquid toner having a predetermined concentration is used for performance of image formation in the liquid-development electrophotographic apparatus, unconsumed liquid toner is collected and adjusted to a predetermined original concentration in the toner concentration adjustment apparatus, and the adjusted liquid toner is recycled.

An electrostatic latent image is formed on the surface of a photosensitive drum 2 by unillustrated, well-known means. The electrostatic latent image on the surface of the photosensitive drum 2 is developed by liquid toner transferred from a development roller 3, so that a toner image is formed. The toner image is transferred to an intermediate transfer member 1. The toner image on the intermediate transfer member 1 is transferred and fixed to a printing medium by unillustrated, well-known means. Liquid toner to be used contains, for example, nonvolatile silicone oil serving as a carrier, in which toner particles consisting of resin and pigment and having a particle size of about 1 to 2 μm are dispersed in a proportion of about 10 to 20%. The term "toner concentration" used in the present specification refers to the proportion of toner particles in the carrier.

Liquid toner (residual toner) which remains on the surface of the photosensitive drum 2 after transfer of the toner image to the intermediate transfer member 1 is scraped off by means of a collection blade 5*a*, and is collected in a collection pot 6*a*. Since the greater portion of toner particles forming the image is transferred from the photosensitive drum 2 to the surface of the intermediate transfer member 1, the liquid toner collected from the photosensitive drum 2 into the collection pot 6*a* is mainly composed of carrier.

Moreover, liquid toner which remains on the surface of the development roller 3 after transfer of the liquid toner to the photosensitive drum 2 is scraped off by means of a collection blade 5*b*, and is collected in a collection pot 6*b*. The liquid toner collected in the collection pot 6*b* can be considered to have formed a negative image corresponding to the toner image formed on the surface of the photosensitive drum 2, and the proportions of its components are substantially the same as those of the liquid toner supplied to the development roller 3 and not having been used for development.

The liquid toner collected in the collection pot 6*a* is led to a carrier pot 20, and is stored there. In response to an instruction, the stored liquid toner is fed to a toner concentration adjustment apparatus 10. The liquid toner collected in the collection pot 6*b* is fed directly to the toner concentration adjustment apparatus 10. Liquid toner having undergone concentration adjustment in the toner concentration adjustment apparatus 10 is fed to a supply pot 7, from which the liquid toner is supplied to the development roller 3 via a supply roller 4, whereby the liquid toner is used for development of electrostatic latent images as described above.

Next, the details of the toner concentration adjustment apparatus 10 will be described with reference to FIG. 2. The toner concentration adjustment apparatus is an apparatus for collecting residual liquid toner which remains after use of liquid toner in the liquid-development electrophotographic apparatus, adjusting its concentration to a predetermined original concentration, and supplying the adjusted liquid toner for reuse. The toner concentration adjustment apparatus 10 includes a carrier extraction mechanism 12, a toner replenishment mechanism 13, a toner concentration detection mechanism 14, and a stirring mechanism 15, which are incorporated in a concentration adjustment pot 11.

Figure 3:
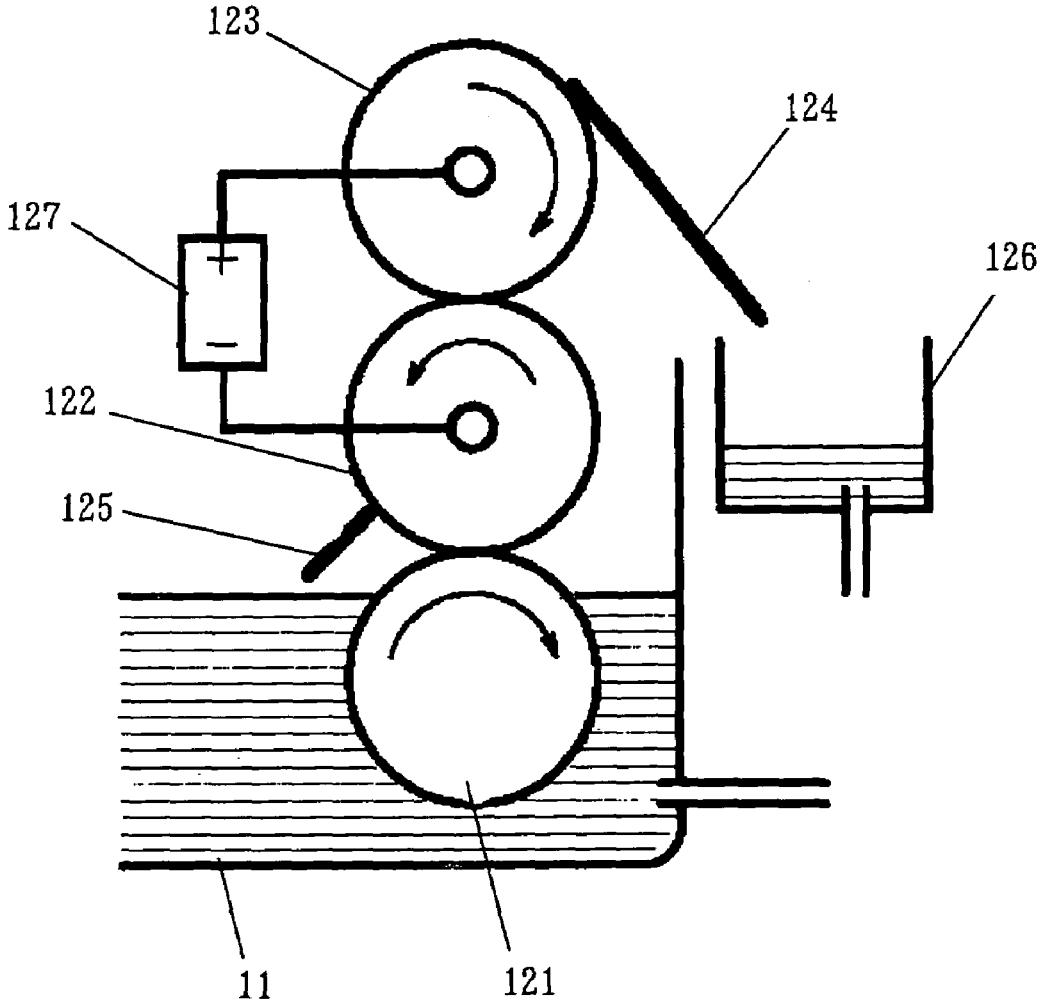
FIG. 3 is a view for explaining the details of a carrier extraction mechanism 12.

First, the details of the carrier extraction mechanism 12 will be described with reference to FIG. 3. The carrier extraction mechanism 12 includes a supply roller 121 immersed in liquid toner which is stored in the concentration adjustment pot 11 and whose concentration is to be adjusted, and is rotated at a predetermined speed; an expansion roller 122 which rotates on the supply roller 121 and receives liquid toner therefrom; and a carrier roller 123 which receives a layer of liquid toner from the expansion roller 122, the thickness of the liquid toner layer being made uniform by means of the surface of the expansion roller 122.

A bias drive source 127 is connected between the expansion roller 122 and the carrier roller 123. The bias drive source 127 causes the expansion roller 122 to serve as a negative pole and the carrier roller 123 to serve as a positive pole. In the case where the liquid-development electrophotographic apparatus is configured in such a manner that toner particles contained in liquid toner are charged positive, by virtue of the bias voltage, the toner particles remain on the expansion roller 122 without moving to the carrier roller 123, and only carrier moves to the carrier roller 123. Accordingly, only carrier is supplied to the surface of the carrier roller 123.

The carrier supplied to the surface of the carrier roller 123 is scraped off by means of a blade 124, and is collected in a collection pot 126. The carrier collected in the collection pot 126 is led to the carrier pot 20 (see FIG. 1), and is stored therein. As described above, the carrier extraction mechanism 12 has a function of extracting the carrier from the liquid toner stored in the concentration adjustment pot 11 and increasing the concentration of the stored liquid toner.

Roller pairs formed by the supply roller 121, the expansion roller 122, and the carrier roller 123 extract the carrier in a larger quantity per unit time as their rotational speeds increase.

Figure 2:
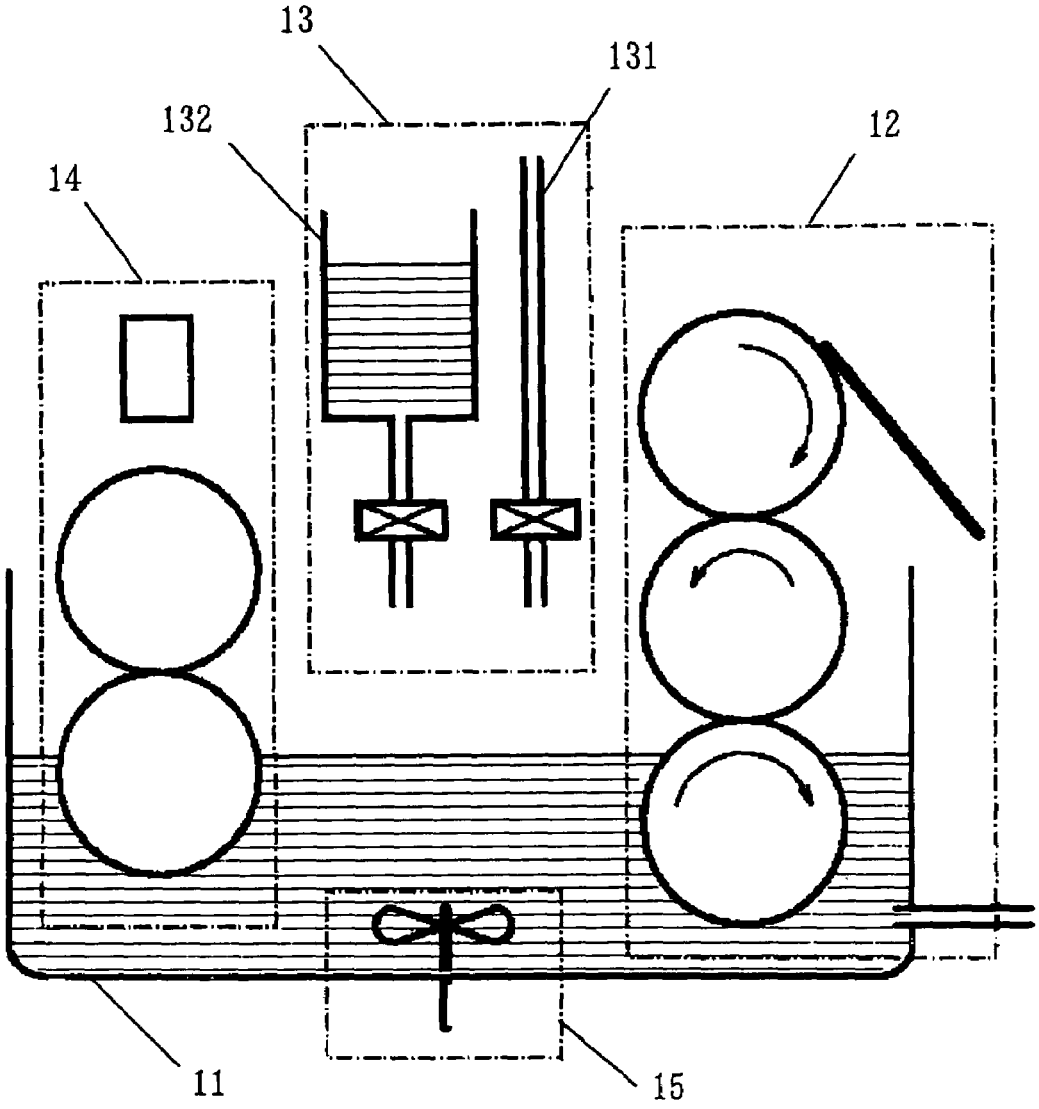
FIG. 2 is a view for explaining the details of a toner concentration adjustment apparatus 10.

As shown in FIG. 2, the toner replenishment mechanism 13 of the toner concentration adjustment apparatus 10 is composed of a carrier replenishment mechanism 131 which introduces the carrier from the carrier pot 20, and a high-concentration toner replenishment mechanism 132 which stores high-concentration toner separately. The high-concentration toner is liquid toner which contains toner particles at a greater proportion than does the liquid toner used for development in the liquid-development electrophotographic apparatus.

Moreover, the toner concentration adjustment apparatus 10 includes the string mechanism 15 for stirring the liquid toner stored in the concentration adjustment pot 11.

Figure 4:
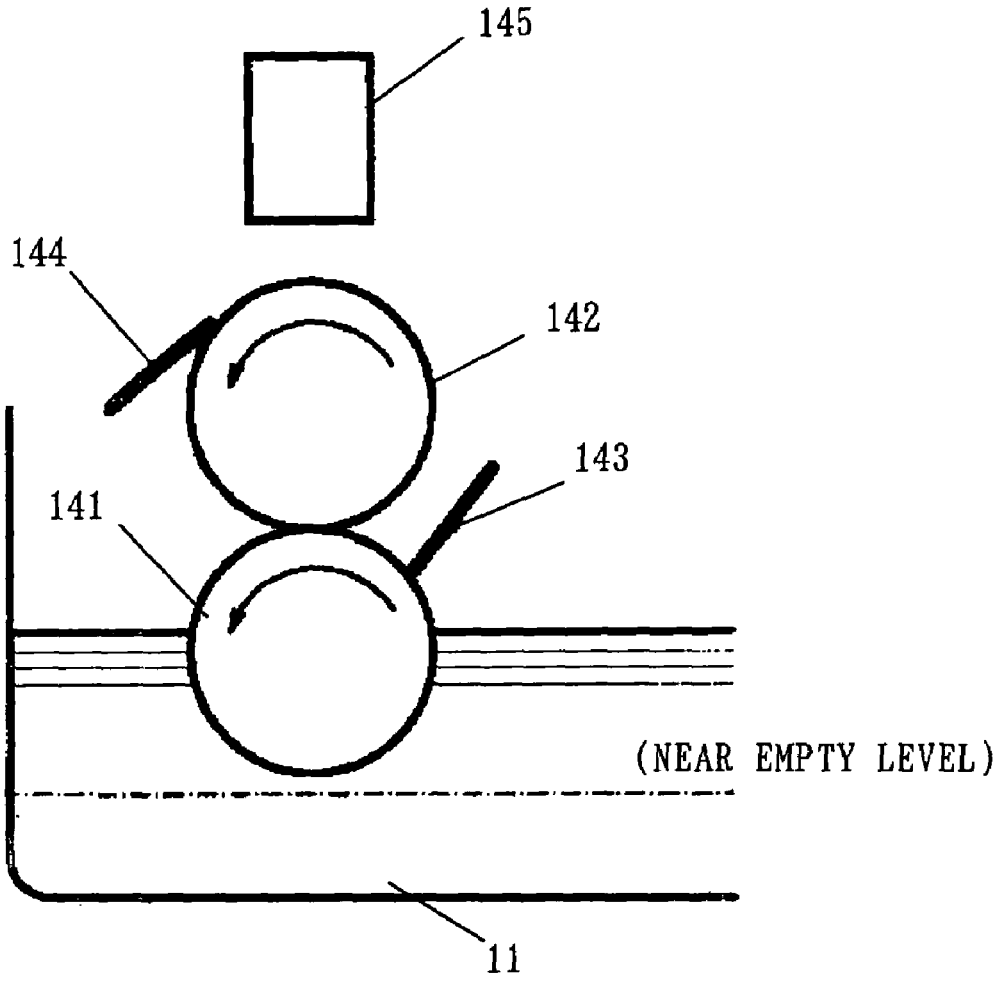
FIG. 4 is a view for explaining the details of a toner concentration detection mechanism 14.

Next, the details of the toner concentration detection mechanism 14 will be described with reference to FIG. 4. The toner concentration detection mechanism 14 includes a supply roller 141 immersed in liquid toner which is stored in the concentration adjustment pot 11 and whose concentration is to be adjusted, and is rotated at a predetermined speed; a reflection roller 142 which rotates on the supply roller 141 and receives liquid toner therefrom; and an optical sensor 145 provided at a position facing the reflection roller 142.

A layer of liquid toner adhering to the surface of the supply roller 141 is regulated to have a predetermined thickness by means of a doctor blade 143, and is then supplied to the surface of the reflection roller 142. The optical sensor 145 emits light-source light, and measures its refection so as to determine the quantity of toner particles contained in the liquid toner layer adhering to the surface of the reflection roller 142 and having a predetermined thickness, to thereby detect the toner concentration. The liquid toner layer used for measurement of toner concentration is scraped off by means of a cleaning blade 144 after the measurement.

When the toner concentration detected by means of the toner concentration detection mechanism 14 increases, the carrier replenishment mechanism 131 (see FIG. 2) is operated so as to replenish carrier. When the toner concentration decreases, the rollers of the carrier extraction mechanism 12 (see FIGS. 2 and 3) are driven to increase their rotation speeds in accordance with the degree of lowness of concentration (a deviation from a target toner concentration toward the lower side), whereby the carrier extraction quantity is increased.

When the quantity of liquid toner stored in the concentration adjustment pot decreases, and its level lowers with the result that the supply roller 141 of the toner concentration detection mechanism 14 separates from the liquid surface, a great change appears in the concentration detected by means of the optical sensor 145. This liquid level at which such a great change occurs is defined as a near empty level (a level close to empty, but not the lowest level) of the liquid toner stored in the toner concentration detection mechanism 14. At the near empty level, the carrier extraction operation of the carrier extraction mechanism 12 is stopped, and replenishment with liquid toner is performed by means of the toner replenishment mechanism 13.

Figure 5:
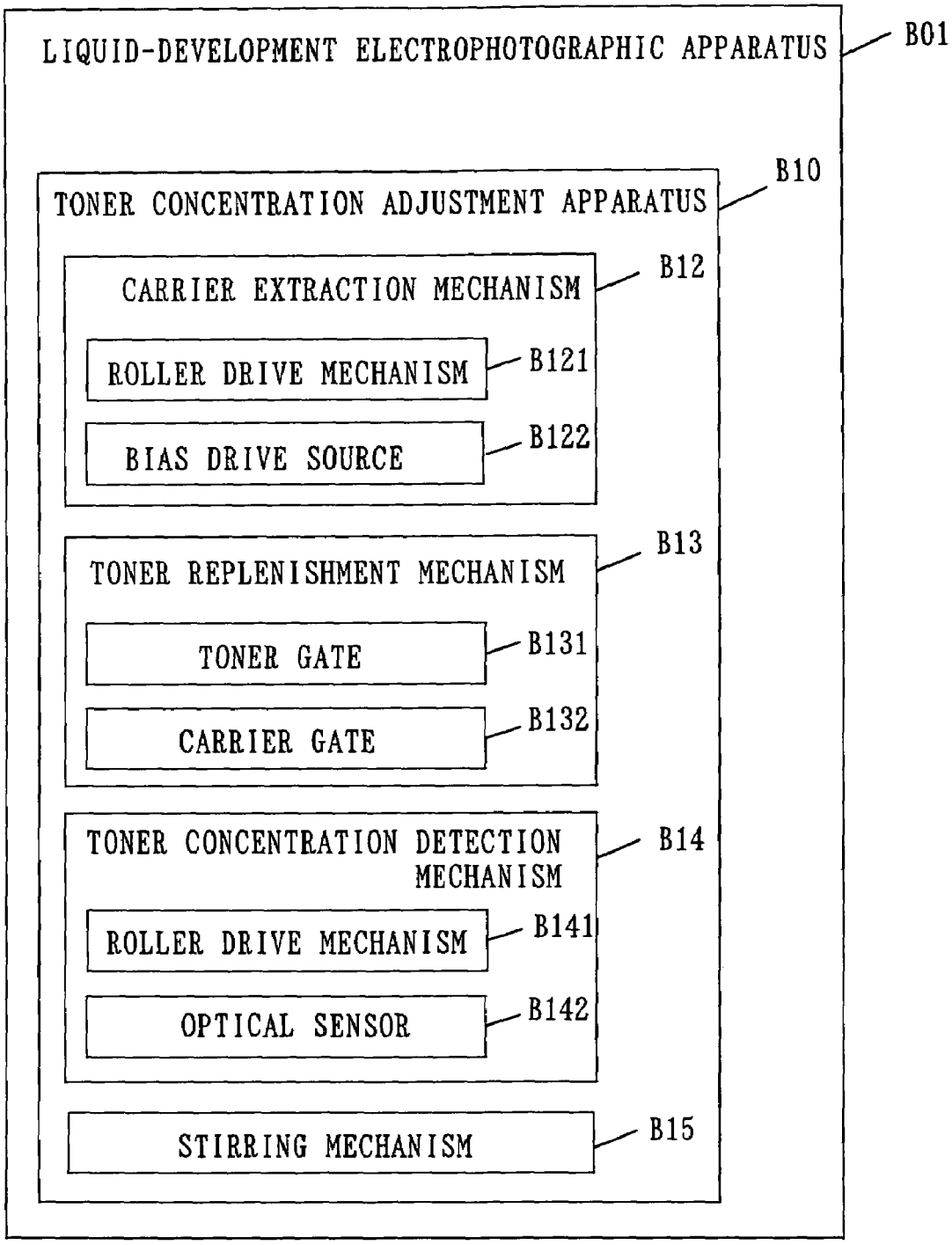
FIG. 5 is a block diagram for explaining elements which constitute the control steps of the toner concentration adjustment apparatus in the liquid-development electrophotographic apparatus.
Figure 6:
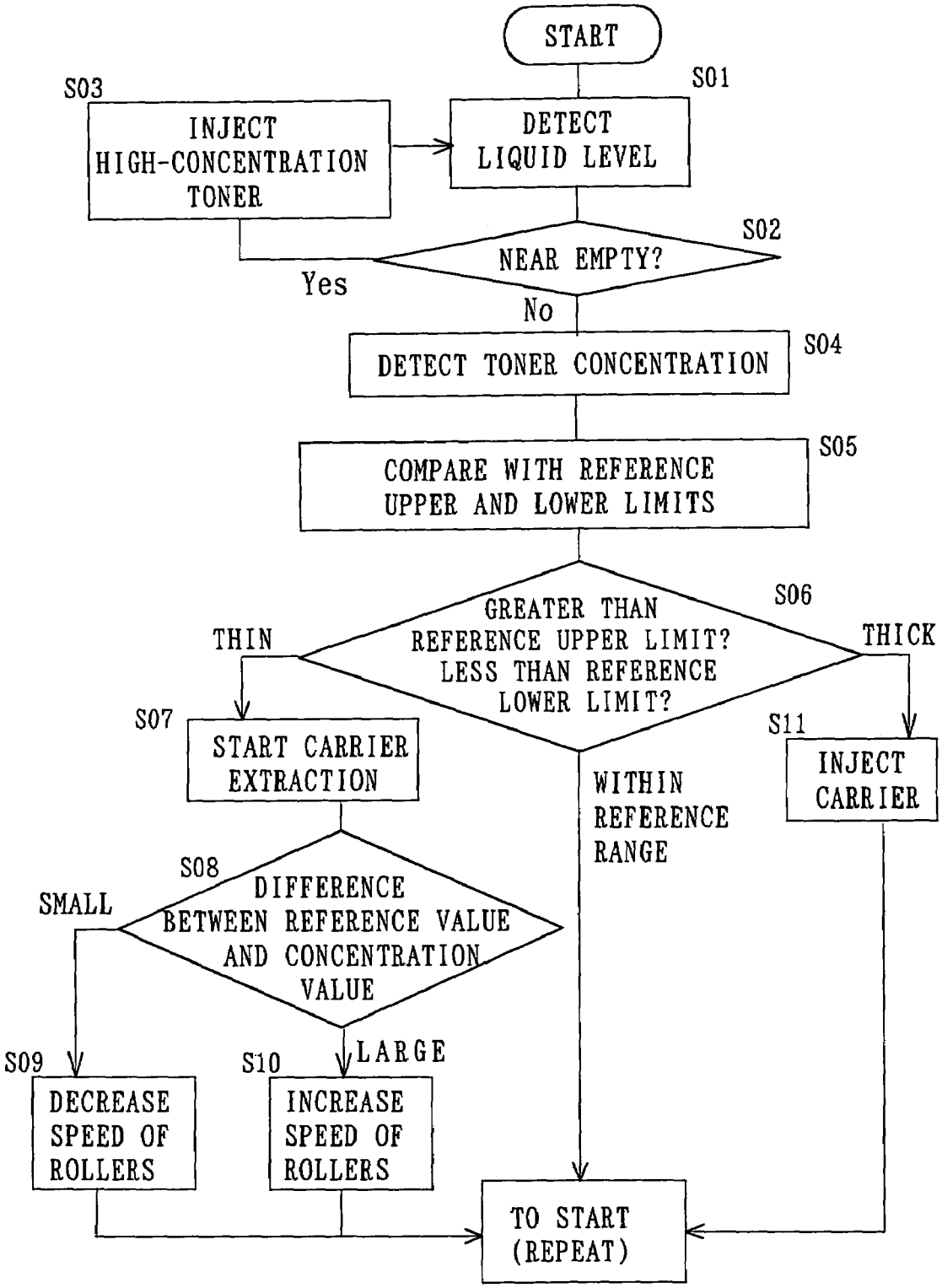
FIG. 6 is a flowchart for explaining the control steps of the toner concentration adjustment apparatus.
Figure 7:
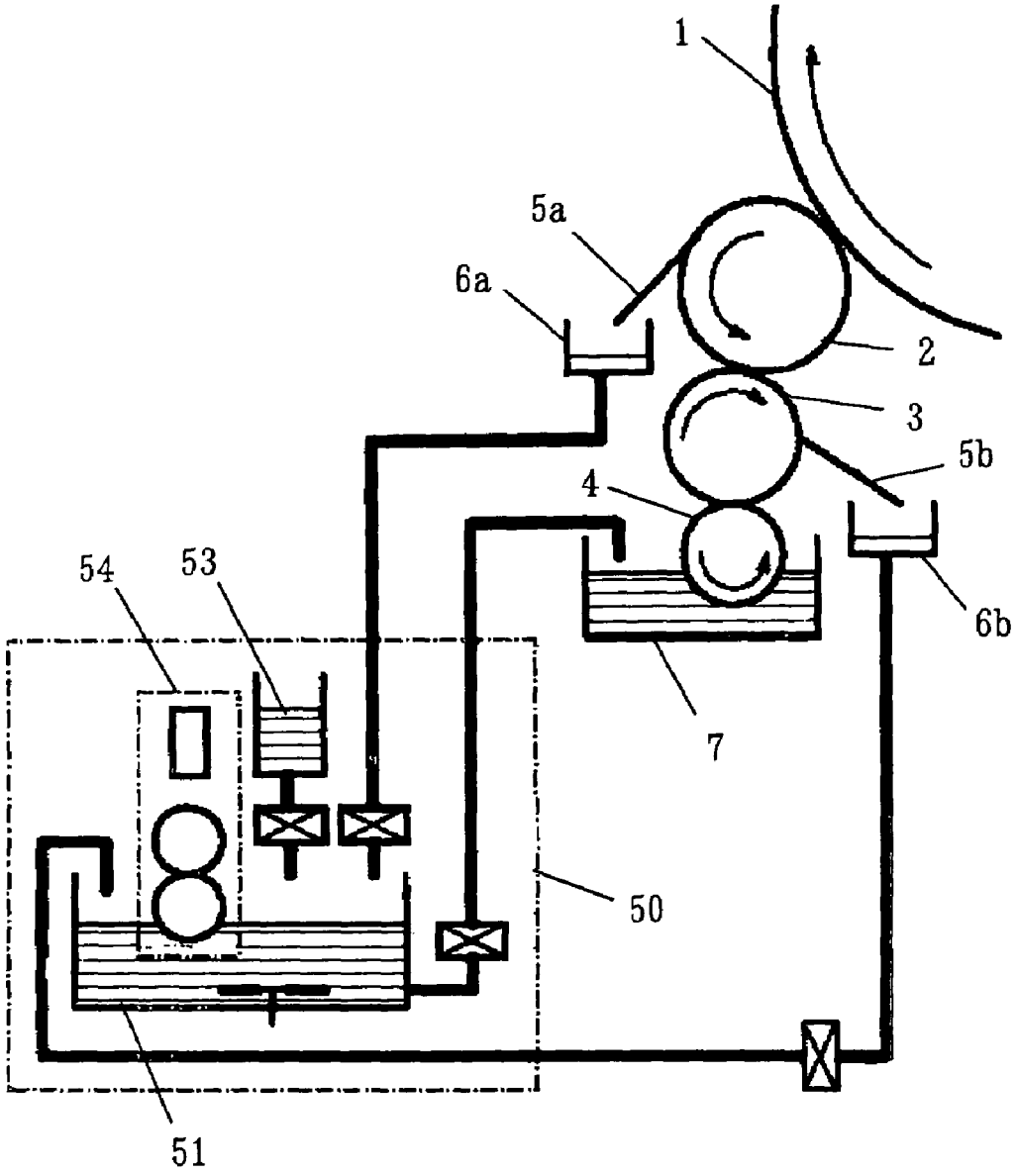
FIG.7 PRIOR ART
FIG. 7 is a view showing a conventional toner concentration adjustment apparatus provided in a liquid-development electrophotographic apparatus.

The steps of control of the toner concentration adjustment apparatus in the liquid-development electrophotographic apparatus will be described with reference to the block diagram of FIG. 5 and the flowchart of FIG. 6. First, elements which constitute the steps of the control will be described with reference to the block diagram of FIG. 5. A toner concentration adjustment apparatus B10 mounted on a liquid-development electrophotographic apparatus B01 includes a carrier extraction mechanism B12, a toner replenishment mechanism B13, a toner concentration detection mechanism B14, and a stirring mechanism B15.

The carrier extraction mechanism B12 includes a roller drive mechanism B121 for rotating rollers at a preset speed; and a bias drive source B122 for applying a bias voltage to the roller train.

The toner replenishment mechanism B13 includes a toner gate B131 provided in a high-concentration toner replenishment mechanism and supplying high-concentration toner to be mixed with liquid toner; and a carrier gate B132 provided in a carrier replenishment mechanism and supplying carrier to be mixed with liquid toner.

The toner concentration detection mechanism B14 includes a roller drive mechanism B141 for rotating rollers at a predetermined constant speed; and an optical sensor B142 for detecting the toner concentration of liquid toner.

The stirring mechanism B15 always stirs the liquid toner stored in a concentration adjustment pot, which constitutes the toner concentration adjustment apparatus B10, to thereby maintain a constant concentration of the liquid toner.

Next, the steps of control which the toner concentration adjustment apparatus executes during a period in which the liquid-development electrophotographic apparatus continues printing operation will be described with reference to the flowchart of FIG. 6.

The liquid level of the concentration adjustment pot is detected in step S01. When the liquid level is determined to be near empty in step S02, the control proceeds to step S03 so as to open the toner gate B131 of the toner replenishment mechanism B13 to thereby inject the high-concentration toner, and open the carrier gate B132 to thereby inject the carrier.

The above operation is repeated until the liquid level is determined not to be near empty in step S02. When the liquid level is determined not to be near empty, the operation proceeds to step S04 so as to detect the toner concentration of the liquid toner stored in the concentration adjustment pot by means of the optical sensor B142 of the toner concentration detection mechanism B14. The control proceeds to step S05 so as to compare the detected toner concentration with reference upper and lower limits.

When the detected toner concentration is determined in step S06 to be lower than the reference lower limit (when the toner is thin), the control proceeds to step S07 so as to start the drive of the roller drive mechanism B121 of the carrier extraction mechanism B12, to thereby start carrier extraction operation.

When in step S08 the difference between the detected toner concentration and the reference value is determined to be greater than a predetermined value, the control proceeds to step S10 so as to issue an instruction for increasing the speed of the roller drive mechanism B121 of the carrier extraction mechanism B12, to thereby enhance the carrier extraction efficiency, whereby the toner concentration is quickly adjusted to the reference concentration. Subsequently, the control returns to the start of this flow.

When in step S08 that the difference between the detected toner concentration and the reference value is determined to be smaller than the predetermined value, the control proceeds to step S09 so as to issue an instruction for decreasing the speed of the roller drive mechanism B121 of the carrier extraction mechanism B12, to thereby lower the carrier extraction efficiency, whereby the toner concentration is accurately adjusted to the reference concentration. Subsequently, the control returns to the start of this flow.

When the detected toner concentration is determined in step S06 to be higher than the reference upper limit (when the toner is thick), the control proceeds to step S11 so as to open the carrier gate B132 of the toner replenishment mechanism B13 to thereby inject the carrier. After that, the control returns to the start of this flow.

When the detected toner concentration is determined in step S06 to fall in a reference value range (to be between the reference upper and lower limits), the control returns directly to the start of this flow.

As described above, since the toner concentration adjustment apparatus according to the present invention is equipped with a mechanism for separating and extracting carrier from liquid toner, the following advantageous effects can be attained. Since injection of high-concentration liquid toner can be suppressed during the process for adjustment of toner concentration, a level increase in the concentration adjustment pot can be prevented, whereby spillover of liquid toner can be prevented.

Since the carrier extraction mechanism of the toner concentration adjustment apparatus is equipped with the bias drive source for applying to the carrier roller a bias voltage of the same polarity as that of toner particles of liquid toner, the carrier extraction mechanism can separate and extract the carrier preferentially.

Moreover, since the quantity of liquid toner stored in the concentration adjustment pot and to undergo concentration adjustment is determined to have reached a near empty level when the toner concentration detected by the toner concentration detection mechanism of the toner concentration adjustment apparatus has greatly dropped, the toner concentration adjustment apparatus can detect the near empty level of the concentration adjustment pot on the basis of a change in toner concentration.

The invention claimed is:

1. A toner concentration adjustment method for a liquid-development electrophotographic apparatus that uses liquid toner composed of carrier and toner particles dispersed in the carrier at a predetermined concentration, in which used liquid toner is collected from the liquid-development electrophotographic apparatus and is adjusted to its predetermined original concentration, and the thus-adjusted liquid toner is recycled, the method comprising:

introducing the collected liquid toner into a concentration adjustment pot, and replenishing the concentration adjustment pot with carrier and high-concentration toner which contains toner particles at a greater proportion than does the liquid toner used in the liquid-development electrophotographic apparatus;

separating and extracting the carrier from the liquid toner stored in the concentration adjustment pot so as to adjust the liquid toner concentration to a predetermined concentration; and reusing the liquid toner, having been adjusted to the predetermined concentration, in the liquid-development electrophotographic apparatus.

2. A toner concentration adjustment method according to claim 1, wherein the step of separating and extracting the carrier includes:

providing a first roller immersed in the liquid toner stored in the concentration adjustment pot and driven to rotate; a second roller rotated on the first roller and receiving liquid toner from the first roller; a third roller for receiving a layer of the liquid toner from the second roller; and a bias voltage source for applying a bias voltage between the second and third rollers; and applying the bias voltage so as to cause toner particles contained in the liquid toner to remain on the second roller, and cause the carrier to move to the third roller, the carrier having moved to the third roller being collected.

3. A toner concentration adjustment method according to claim 2, wherein the rotational speeds of the first, second, and third rollers rolling on one another are controlled in accordance with a detected toner concentration of the liquid toner stored in the concentration adjustment pot so as to adjust the quantity of the collected carrier.

4. A toner concentration adjustment method according to claim 1, wherein the carrier separated and extracted from the liquid toner stored in the concentration adjustment pot is introduced into the concentration adjustment pot as a replenishing carrier.

5. A toner concentration adjustment method according to claim 1, wherein the liquid toner collected after use includes liquid toner remaining on a surface of a photosensitive drum after transfer of a toner image to an intermediate transfer member, and liquid toner remaining on a development roller after supply of liquid toner from the development roller to the photosensitive drum.

6. A toner concentration adjustment apparatus for a liquid-development electrophotographic apparatus that uses liquid toner composed of carrier and toner particles dispersed in the carrier at a predetermined concentration, in which used liquid toner is collected from the liquid-development electrophotographic apparatus and is adjusted to its predetermined original concentration, and the thus-adjusted liquid toner is recycled, the apparatus comprising:

a concentration adjustment pot into which collected liquid toner is introduced;

supply mechanisms for replenishing the concentration adjustment pot with carrier and high-concentration toner, respectively, the high-concentration toner containing toner particles at a greater proportion than does the liquid toner used in the liquid-development electrophotographic apparatus; and a carrier extraction mechanism for separating and extracting the carrier from the liquid toner stored in the concentration adjustment pot, wherein the liquid toner having been adjusted to the predetermined concentration in the concentration adjustment pot is reused in the liquid-development electrophotographic apparatus.

7. A toner concentration adjustment apparatus according to claim 6, wherein the carrier extraction mechanism includes a first roller immersed in the liquid toner stored in the concentration adjustment pot and driven to rotate; a second roller rotated on the first roller and receiving liquid toner from the first roller; a third roller for receiving a layer of the liquid toner from the second roller; and a bias voltage source for applying a bias voltage between the second and third rollers, wherein through application of the bias voltage, toner particles contained in the liquid toner are caused to remain on the second roller, and the carrier is caused to move to the third roller; and the carrier having moved to the third roller is collected.

8. A toner concentration adjustment apparatus according to claim 7, wherein the rotational speeds of the first, second, and third rollers rolling on one another are controlled so as to adjust the quantity of the collected carrier.

9. A toner concentration adjustment apparatus according to claim 6, further comprising a carrier pot for storing a carrier with which the concentration adjustment pot is replenished, wherein the carrier separated and extracted by means of the carrier extraction mechanism is introduced into the carrier pot.

10. A toner concentration adjustment apparatus according to claim 6, wherein the liquid toner collected after use includes liquid toner remaining on a surface of a photosensitive drum after transfer of a toner image to an intermediate transfer member, and liquid toner remaining on a development roller after supply of liquid toner from the development roller to the photosensitive drum.

11. A toner concentration adjustment apparatus according to claim 6, further comprising a mechanism for detecting the concentration of the liquid toner stored in the concentration adjustment pot.

12. A toner concentration adjustment apparatus according to claim 11, wherein the mechanism for detecting the toner concentration includes a supply roller immersed in liquid toner stored in the concentration adjustment pot, and rotated at a predetermined speed; a reflection roller which rotates on the supply roller and receives liquid toner therefrom; and an optical sensor provided at a position facing the reflection roller.

13. A toner concentration adjustment apparatus according to claim 12, wherein the liquid toner which is stored in the concentration adjustment pot and which undergoes concentration adjustment is determined to have reached a near empty level when the toner concentration detected by means of the toner concentration detection mechanism has greatly dropped.

14. A toner concentration adjustment apparatus according to claim 12, wherein in accordance with the toner concentration detected by means of the toner concentration detection mechanism, replenishment with carrier or carrier extraction by means of the carrier extraction mechanism is performed.

* * * * *